US008035671B2

(12) United States Patent
Evans

(10) Patent No.: US 8,035,671 B2
(45) Date of Patent: Oct. 11, 2011

(54) DUAL-USE SENSOR ASSEMBLY FOR A THERMAL PRINTER

(75) Inventor: Stuart Gerard Evans, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 513 days.

(21) Appl. No.: 12/276,693

(22) Filed: Nov. 24, 2008

(65) Prior Publication Data

US 2010/0128099 A1 May 27, 2010

(51) Int. Cl.
*B41J 2/00* (2006.01)

(52) U.S. Cl. ..... 347/188

(58) Field of Classification Search ..... None
See application file for complete search history.

(56) References Cited

U.S. PATENT DOCUMENTS

| | | | |
|---|---|---|---|
| 6,431,679 B1 | 8/2002 | Li et al. | 347/19 |
| 6,710,796 B1 | 3/2004 | Miyazaki et al. | 347/256 |
| 7,271,935 B2 | 9/2007 | Coons et al. | 358/2.1 |

OTHER PUBLICATIONS

Texas Advanced Optoelectronic Solutions Inc. (TAOS Inc.), The *Lumenology*® Company; "TCS230 Programmable Color Light-To-Frequency Converter"; TAOS046A—Jan. 2004; pp. 1-10.

Nichia Corporation; "Specifications for Nichia White LED—Model: NSPW500BS"; No. STSE-CW2159B; <Cat. No. 031020>; pp. 1-14.

OSRAM; Opto Semiconductors; 6-lead MULTILED®—Enhanced optical Power LED (HOP2000 / ATON®)—LATB G66B; Nov. 17, 2003; pp. 1-20.

*Primary Examiner* — Stephen Meier
*Assistant Examiner* — Alexander C Witkowski
(74) *Attorney, Agent, or Firm* — Stephen H. Shaw

(57) ABSTRACT

A sensor apparatus for providing two sensing operations within a thermal printer includes a densitometer with at least one light source that discriminates color and that is positioned in a first position for sensing donor patches within the thermal printer; the densitometer while in a second position provides signals from printed receiver media for internal color calibration of the thermal printer. At least one reflector directs light from the light source to the densitometer through a donor web when the densitometer is in the first position; and a switchable device repositions the densitometer from either the first position or the second position.

9 Claims, 8 Drawing Sheets

DUAL-USE SENSOR ASSEMBLY FOR A THERMAL PRINTER

FIELD OF THE INVENTION

The present invention relates to thermal printers that record images by transferring donor materials from a donor ribbon to a receiver medium.

BACKGROUND OF THE INVENTION

In thermal printing, it is generally well known to render images by heating and pressing one or more donor materials such as dye, colorant or other coating against a receiver medium. The donor materials are provided in sized donor patches on a moveable web known as a donor ribbon. The donor patches are organized on the ribbon into donor patch sets, each donor patch set contains all of the donor patches that are to be used to record an image on the receiver medium. For full color images, multiple colored dye sets can be used, such as yellow, magenta and cyan donor dye patches. Arrangements of other color patches can be used in like fashion within a donor patch set. Additionally, each donor set can include an overcoat or sealant layer.

It will be appreciated from this that it is necessary to neutrally calibrate the printer by methods known to those skilled in the art. This calibration is performed to ensure that the output performance of the thermal printer remains within tolerance from unit-to-unit and media set to media set. Such calibration can be done at the factory by means of multiple look-up-tables (LUTs), one for each color. Additionally, the thermal printhead voltage may be adjusted for the total range of printer operation. As this calibration is performed at the factory, there is no means to compensate for onsite variability involving printer usage, media changes and environmental conditions at the customer site. In some of these situations, better color adjustment is required to adjust the printer settings to compensate for these variables.

SUMMARY OF THE INVENTION

Whereas an operator of a thermal printer may print and measure a neutral tone scale, calculate and download new LUTs into the thermal printer, it is desirable that the calibration measurement means be embedded within the printer, and the measurement operation be performed automatically with little or no operator intervention. This typically involves integration of an embedded color sensor, densitometer, calorimeter or spectrophotometer inside the printer to measure the reflection density of the multiple colors printed on the receiver. The reflection density of a neutral or color tone scale is typically measured. This data is used to make adjustments to the LUTs or other printing parameters to obtain optimum color rendition.

Additionally, thermal color printers should preferably be able to distinguish the edges, position and color of the donor dye patches on the web. For donor webs with three-color dye patch sets, a three-color sensor is typically employed to sense the edges of said dye patches as the donor web is moving. This donor patch sensor assembly is in addition to and separate from the embedded reflection color sensor, densitometer, calorimeter or spectrophotometer (henceforth a reflection densitometer) inside the printer, which is used for the purposes of neutral or color calibration.

According to the present invention, a thermal printer incorporating an embedded reflection densitometer used for the purpose of neutral or color calibration (henceforth calibration), has been designed to allow said embedded reflection densitometer to also sense donor patches while donor and receiver are moving, and therefore at a time when it is not needed to measure reflection density from a tone scale on printed receiver. This eliminates the requirement for a separate donor patch sensor assembly. While the specifications for the embedded densitometer are more stringent than for the donor patch sensor assembly, it is a device capable of discriminating color. This capability can be adapted and employed for the additional purpose of sensing color patch edges on moving donor and for positioning color patches for printing.

In a first aspect of the invention, a sensor apparatus provides two sensing operations within a thermal printer. The sensor apparatus includes a densitometer, which discriminates color and is positioned in a first position for sensing donor patches within the thermal printer. When the single sensor is in a second position, it provides a signal for internal color calibration of a receiver media. A light source provides light to at least one reflector that directs the light towards the densitometer. A switchable device repositions the densitometer from either the first position or the second position.

Repeatedly measuring the reflected color as the donor web is moving, allows detection of the color patch edges to be positioned for printing. The second position aims the densitometer aperture at the printed receiver, allowing reflection measurements on the printed receiver. A control system is provided to operate the mechanical articulation means, which may include a motor or a solenoid with a spring return, or other convenient method. The mechanical articulation means allow the spring to return the densitometer aperture to position 1 for normal operation including donor movement, and to drive the densitometer aperture to position 2 when required to reflectively measure the density of a completed print.

In a second aspect of the invention, means can be provided to split the beam of light and use two mutually exclusive light sources to select between donor patch detection and reflection density measurement. The light sources can be monochromatic or multi-colored depending on the exact configuration desired.

DETAILED DESCRIPTION OF THE INVENTION

Figure 1:
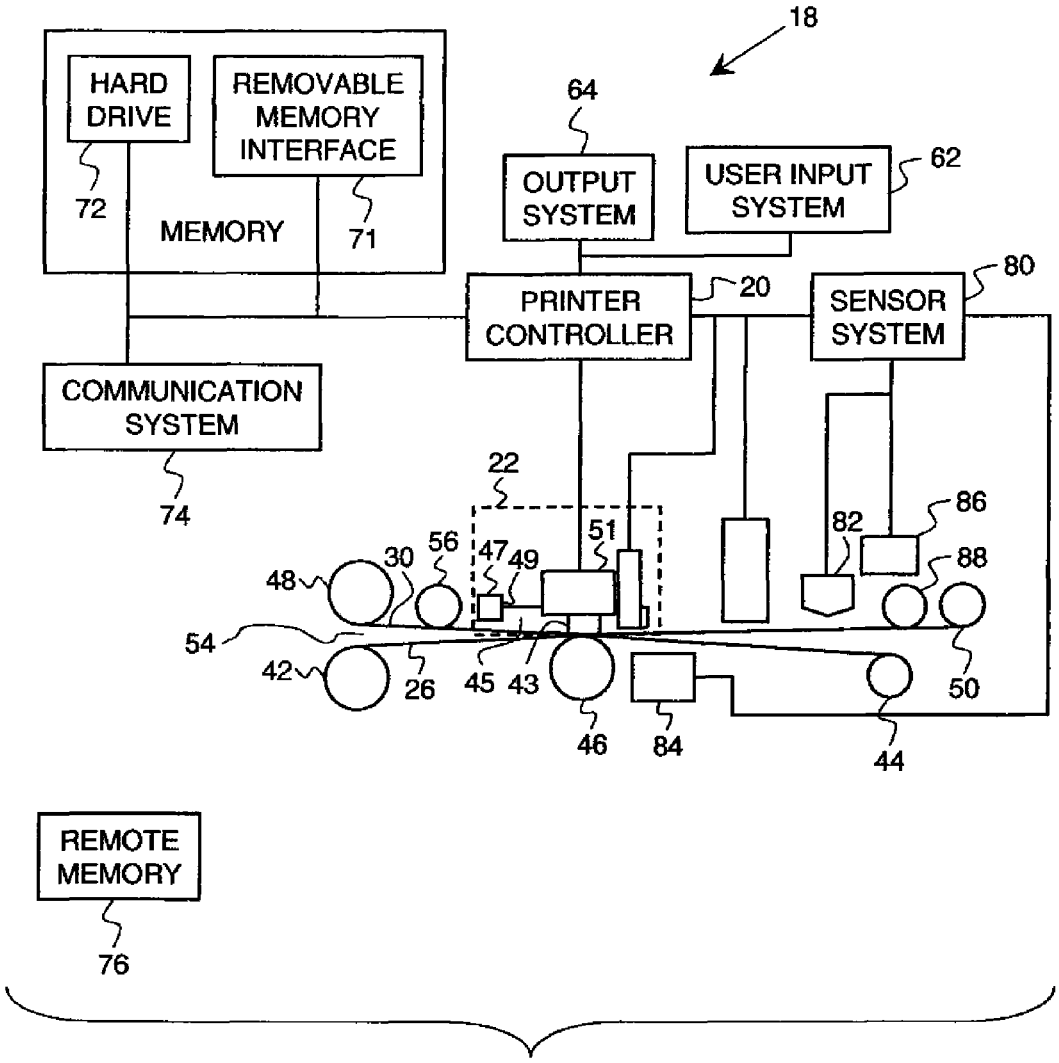
FIG. 1 (PRIOR ART)
FIG. 1 shows a prior art thermal printer with a control system.

FIG. 1 shows one embodiment of a conventional thermal printer of the prior art, 18. It shares many of the same features as that of the present invention. As shown in FIG. 1, thermal printer 18 has a printer controller 20 that causes printhead 22 to record images on a receiver medium 26 by applying heat and pressure to transfer material from a donor web 30 to receiver medium 26. Printer controller 20 can include but is not limited to a programmable digital computer, a programmable microprocessor, a programmable logic controller, a series of electronic circuits, a series of electronic circuits reduced to the form of an integrated circuit, or a series of discrete components. In the embodiment of FIG. 1, printer controller 20 also controls a receiver medium take-up roller 42, a receiver medium supply roller 44, a donor web take-up roller 48 and a donor web supply roller 50, which are each motorized for rotation on command of the printer controller 20 to effect movement of receiver medium 26 and donor web 30.

Figure 2:
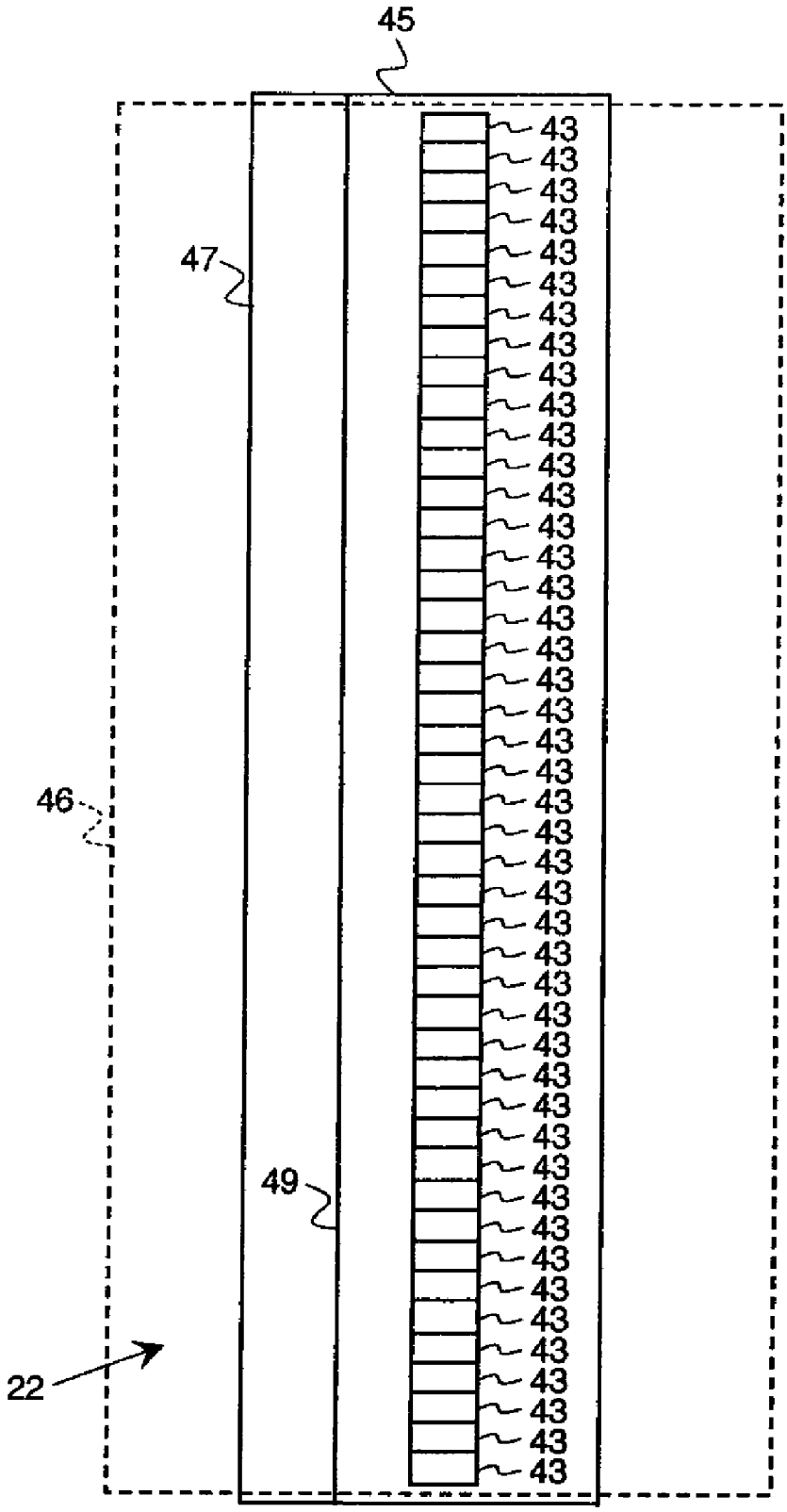
FIG. 2 shows a bottom view of a typical thermal printhead used in the thermal printer of FIG. 1.

FIG. 2 shows a bottom view of an illustration of one embodiment of a conventional thermal printhead 22 with an array of thermal resistors 43 fabricated in a ceramic substrate 45. A heat sink 47, typically in the form of an aluminum backing plate, is fixed to a left side 49 of ceramic substrate 45. Heat sink 47 rapidly dissipates heat generated by the thermal resistors 43 during printing. In the embodiment shown in FIG. 2, thermal resistors 43 are arranged in a linear array extending across platen roller 46 (shown in phantom). Such a linear arrangement of thermal resistors 43 is commonly known as a heat line or print line. However, other non-linear arrangements of thermal resistors 43 can be used. Further, it will be appreciated that there are a wide variety of other arrangements of thermal resistors 43 and thermal printhead 22 that can be used in conjunction with the present invention.

Thermal resistors 43 are adapted to generate heat in proportion to an amount of electrical energy that passes through thermal resistors 43. During printing, printer controller 20 transmits signals to a circuit board 51 to which thermal resistors 43 are connected causing different amounts of electrical energy to be applied to thermal resistors 43 so as to selectively heat donor web 30 in a manner that is intended to cause donor material from donor patch sets 32.1 and 32.2, to be applied to receiver medium 26 in a desirable manner.

Figure 3:
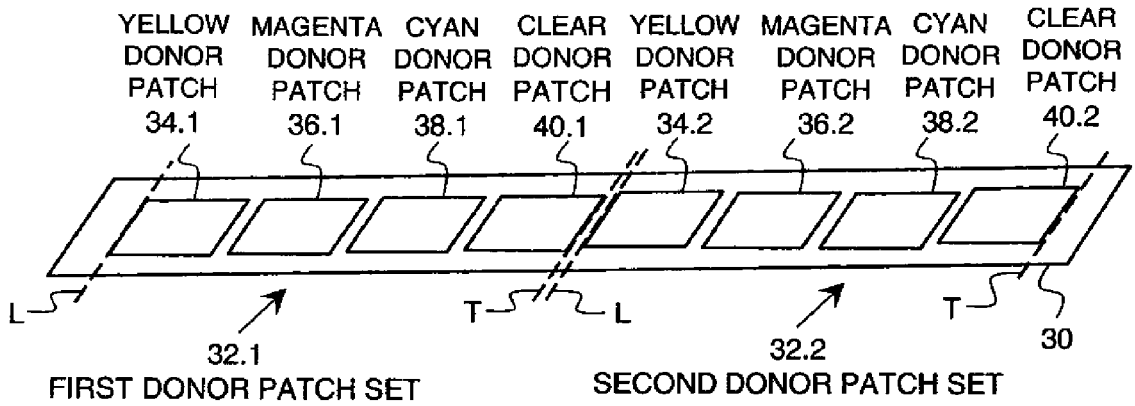
FIG. 3 shows a typical donor web with three color donor patches and one clear donor patch.

As is shown in FIG. 3, donor web 30 comprises a first donor patch set 32.1 having a yellow donor patch 34.1, a magenta donor patch 36.1, a cyan donor patch 38.1 and a clear donor patch 40.1 and a second donor patch set 32.2 having a yellow donor patch 34.2, a magenta donor patch 36.2, a cyan donor patch 38.2 and a clear donor patch 40.2. Each donor patch set 32.1 and 32.2 has a leading edge (L) and a trailing edge (T). In order to provide a full color image with a clear protective coating, the four patches of first donor patch set 32.1 and the second donor patch set 32.2, etc. are printed, in registration with each other, onto a common image receiving area 52 of receiver medium 26 shown in FIG. 4. Circuit board 51 provides variable electrical signals to thermal resistors 43 in accordance with the signal from printer controller 20.

A first color is printed in the conventional direction, from right to left as seen by the viewer in FIGS. 1 and 3. During printing, printer controller 20 raises printhead 22 and actuates donor web supply roller 50 and donor web take-up roller 48 to advance a leading edge (L) of a first donor patch set 32.1 to printhead 22. In the embodiment illustrated in FIGS. 1 through 3, leading edge (L) for first donor patch set 32.1 is defined by a leading edge of a yellow donor patch 34.1. As will be discussed in greater detail below, the position of this leading edge (L) can be determined by using a position sensor of the prior art to detect a marking, indicia on donor web 30 that has a known position relative to the leading edge of yellow donor patch 34.1 or by directly detecting leading edge of yellow donor patch 34.1 as will be discussed in greater detail below.

Printer controller 20 also actuates receiver medium take up roller 42 and receiver medium supply roller 44 so that image receiving area 52 of receiver medium 26 is positioned with respect to the printhead 22. In the embodiment illustrated, image receiving area 52 is defined by a leading edge and a trailing edge on receiver medium 26, (LER) and (TER), respectively. Donor web 30 and receiver medium 26 are positioned so that leading edge (L) of yellow donor patch 34.1 is registered at printhead 22 with leading edge (LER) of image receiving area 52. Printer controller 20 then causes a motor or other conventional structure to (not shown) lower printhead 22 so that a lower surface of donor web 30 engages receiver medium 26, which is supported by platen roller 46. This creates a pressure holding donor web 30 against receiver medium 26.

Printer controller 20 then actuates receiver medium take-up roller 42, receiver medium supply roller 44, donor web take-up roller 48 and donor web supply roller 50 to move receiver medium 26 and donor web 30 together past the printhead 22. Concurrently, printer controller 20 selectively operates heater elements in printhead 22 to transfer donor material yellow donor patch 34.1 to receiver medium 26.

Figure 4:
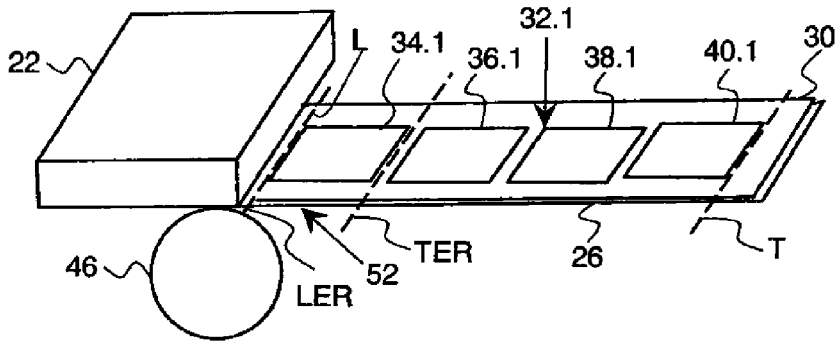
FIG. 4 shows a thermal printhead, platen roller, donor web, and receiver medium during printing.
Figure 5:
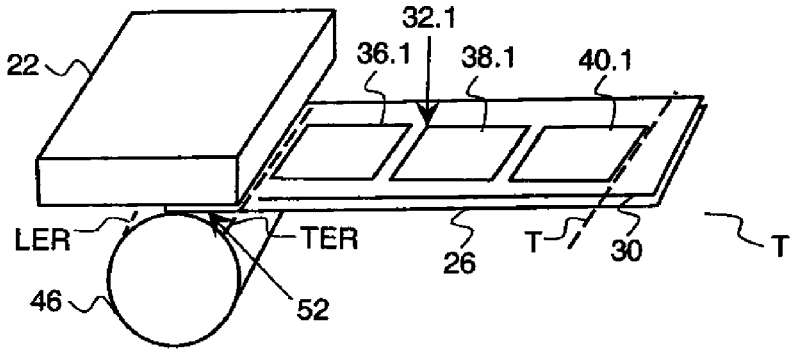
FIG. 5 shows a thermal printhead, platen roller, donor web, and receiver medium during printing.

As donor web 30 and receiver medium 26 leave the printhead 22, a stripping plate 54 separates donor web 30 from receiver medium 26. Donor web 30 continues over idler roller 56 toward the donor web take-up roller 48. As shown in FIG. 4, the trailing edge receiver of image receiving area 52 (TER) of receiver medium 26 remains on platen roller 46. Printer controller 20 then adjusts the position of donor web 30 and receiver medium 26 using a predefined pattern of donor web movement so that a leading edge of each of the remaining donor patches 36.1, 38.10, and 40.1 in the first donor patch set 32.1 are brought into alignment with leading edge receiver of image receiving area 52 (LER) and the printing process is repeated to transfer further material as desired to complete image format.

Printer controller 20 operates the thermal printer 18 based upon input signals from a user input system 62, an output system 64, a memory 68, a communication system 74 and sensor system 80. User input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by printer controller 20 to provide human perceptible signals for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with thermal printer 18 and a remote memory 76 that is external to printer controller 20 such as a personal computer, computer network or other imaging system.

In the embodiment shown in FIG. 1, printer controller 20 has a communication system 74 for communicating external devices such as remote memory 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Printer controller 20 can also receive information and instructions from signals received by communication system 74.

Sensor system 80 includes circuits and systems that are adapted to detect conditions within thermal printer 18 and, optionally, in the environment surrounding thermal printer 18 and to convert this information into a form that can be used by printer controller 20 in governing printing operations. Sensor system 80 can take a wide variety of forms depending on the type of media therein and the operating environment in which thermal printer 18 is to be used.

In the embodiment of FIG. 1, sensor system 80 includes an optional donor position sensor 82 that is adapted to detect the position of donor web 30 and a receiver medium position sensor 84. Printer controller 20 cooperates with donor position sensor 82 to monitor donor web 30 during movement thereof so that printer controller 20 can detect one or more conditions on donor web 30 that indicate a leading edge of a donor patch set. In this regard, a donor web 30 can be provided that has markings or other optically, magnetically or electronically sensible indicia between first donor patch set 32.1 and second patch set 32.2. Where such markings or indicia are provided, donor position sensor 82 is provided to sense these markings or indicia and to provide signals to the printer controller 20. Printer controller 20 can use these markings and indicia to determine when donor web 30 is positioned with the leading edge of the donor patch set at printhead 22. In a similar way, printer controller 20 can use signals from receiver medium position sensor 84 to monitor the position of the receiver medium 26 to align receiver medium 26 during printing. Receiver medium position sensor 84 can be adapted to sense markings or other optically, magnetically or electronically sensible indicia between each image receiving area of receiver medium 26.

During a full image printing operation, printer controller 20 causes donor web 30 to be advanced in a predetermined pattern of distances so as to cause a leading edge of each of the first donor patches 34.1, 36.1, 38.1, and 40.1 to be properly positioned relative to the first image receiving area 52.1 at the start each printing process. Printer controller 20 can optionally be adapted to achieve such positioning by precise control of the movement of donor web 30 using a stepper type motor for motorizing donor web take-up roller 48 or donor web supply roller 50 or by using a movement sensor 86 that can detect movement of donor web 30. In one example, an arrangement using a movement receiver medium position sensor 84, a follower wheel 88 is provided that engages donor web 30 and moves therewith. Follower wheel 88 can have surface features that are optically, magnetically or electronically sensed by movement sensor 86. One example of this is a follower wheel 88 that has markings thereon indicative of an extent of movement of donor web 30 and a movement sensor 86 that has a light sensor that can sense light reflected by the markings. In other optional embodiments, perforations, cutouts or other routine and detectable indicia can be incorporated onto donor web 30 in a manner that enables movement receiver medium position sensor 84 to provide an indication of the extent of movement of the donor web 30.

Alternatively, donor position sensor 82 can also optionally be adapted to sense the color of donor patches on donor web 30 and can provide color signals to the printer controller 20. In this alternative, printer controller 20 is programmed or otherwise adapted to detect a color that is known to be found in the first donor patch, e.g., yellow donor patch 34.1 in a donor patch set such as first donor patch set 32.1. When the first color is detected, printer controller 20 can determine that donor web 30 is positioned proximate to the start of a donor patch set.

In the prior art printer described above, and shown in FIG. 1, donor position sensor 82, has only one function, which is to sense the color of donor patches on donor web to provide positioning information. In the present invention, this function is embodied in color sensor (e.g. densitometer) 486 and 486.1 shown in FIGS. 6 and 7 respectively. Additionally, for this invention, color sensor densitometers 486 and 486.1 provide the second function for measuring the reflection density of the printed receiver. Thus, a single color sensor, in this case a densitometer, is enabled with dual functionality.

Figure 6:
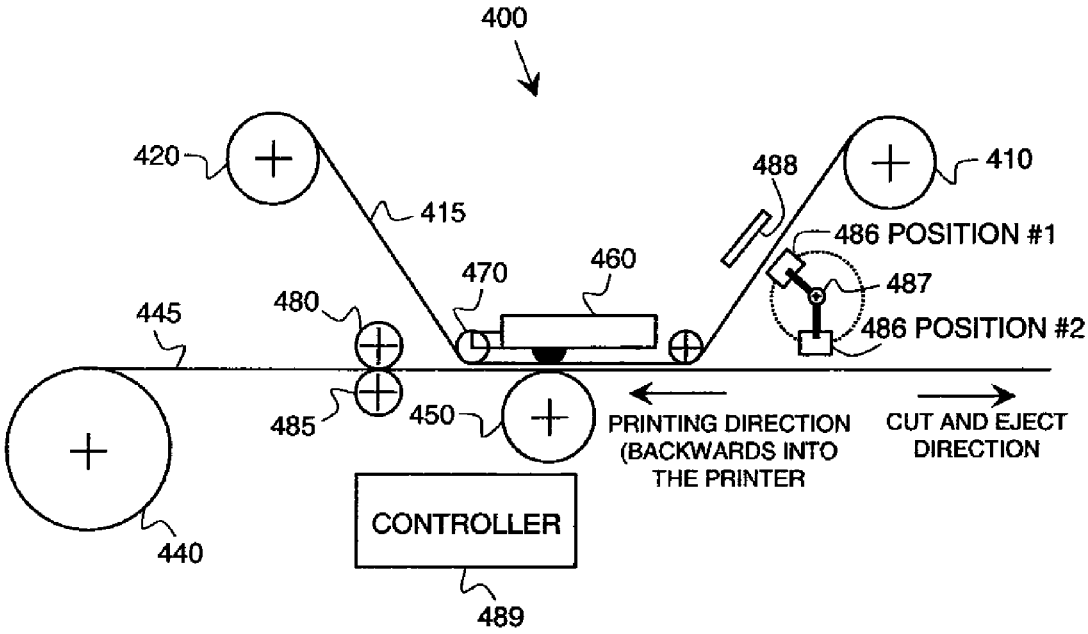
FIG. 6 illustrates a thermal printer system of the present invention utilizing an articulating color sensor densitometer.

The thermal printer schematic of the present invention 400 shown in FIG. 6 includes a donor supply spool 410 for distributing a donor web 415. A donor take-up spool 420 removes slack donor web 415. A receiver medium 440 distributes receiver web 445. Receiver web 445 and donor web 415 are merged together atop platen roller 450 and beneath a thermal ceramic printhead 460 that includes a peel bar member 470. Subsequent to the thermal ceramic printhead 460 adhering donor material on the donor web 415 to the receiver web 445, the peel bar member 470 separates the donor web 415 from the receiver web 445. Donor web 415 continues to travel on to the donor take-up spool 420, while the receiver web 445 travels between a pinch roller 480 and a micro-grip roller 485 that form a nip.

Referring to FIG. 6, color sensor (densitometer) 486 can perform two functions, a donor position sensor when in position #1 and a reflection densitometer when in position #2. The change in position means to move the color sensor (densitometer) 486 about pivot 487.

When color sensor (densitometer) 486 is acting as a donor position sensor, its color discrimination ability allows the donor patches to be identified by color and the donor patch edge position to be sensed by the printer controller 20. Once the donor patch edge position is known by the controller, the beginning of said patch can be positioned for printing between the thermal ceramic printhead 460 and the platen roller 450. Reference FIG. 3 illustrates a representation of the donor patches: 34.1, 36.1, 38.1, 40.1 34.2, 36.2, 38.2, and 40.2. As the donor web 415 is transported through the printer, light from the color sensor (densitometer) 486 passes through the donor web 415 and reflects off reflector 488 and back into the color sensor (densitometer) 486. In this manner, the position of the various donor patches, shown in FIG. 3: 34.1, 36.1, 38.1, 40.1, 34.2, 36.2, 38.2, and 40.2; can be determined and positioned for printing between thermal ceramic printhead 460 and platen roller 450.

Figure 9:
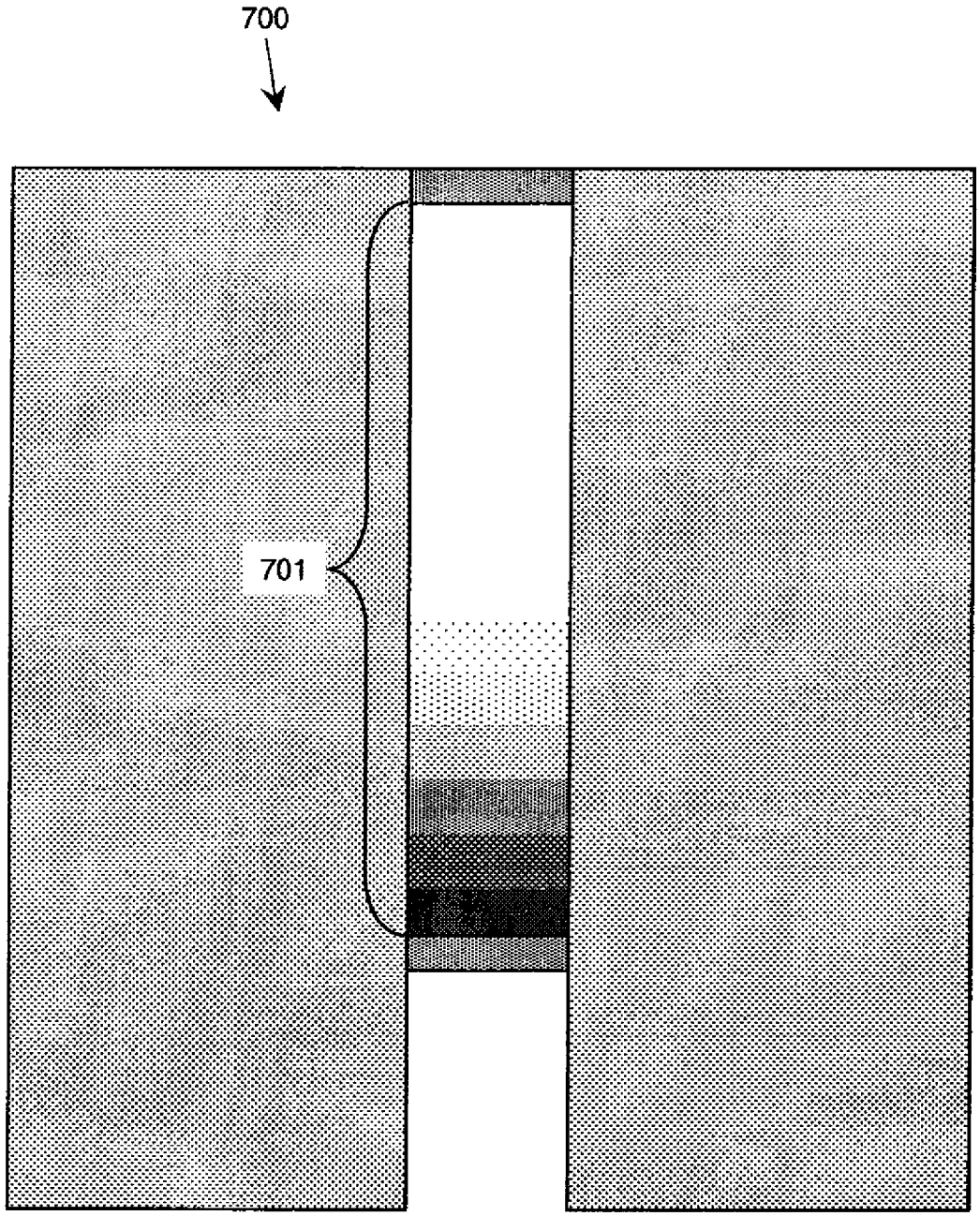
FIG. 9 illustrates an example of a calibration target with a corresponding plurality of dye patches constituting a tone scale.

When printer calibration is required the color sensor (densitometer) 486 is switched to position #2, to measure the reflection density of the printed receiver. Referring to FIG. 9, a test target 700 is printed on the receiver web 445. The test target contains a tone scale 701, consisting of a plurality of discrete patches ranging from light to dark (low density to high density). Each patch is scanned by color sensor (densitometer) 486 as the printed receiver is passed under it to determine its reflection density. The density information is passed to a calibration algorithm in controller 489, which can calculate new printing parameters to be utilized by controller 489 to make neutrally corrected and/or color corrected prints. Such calibration algorithms are known to those skilled in the art.

Figure 7:
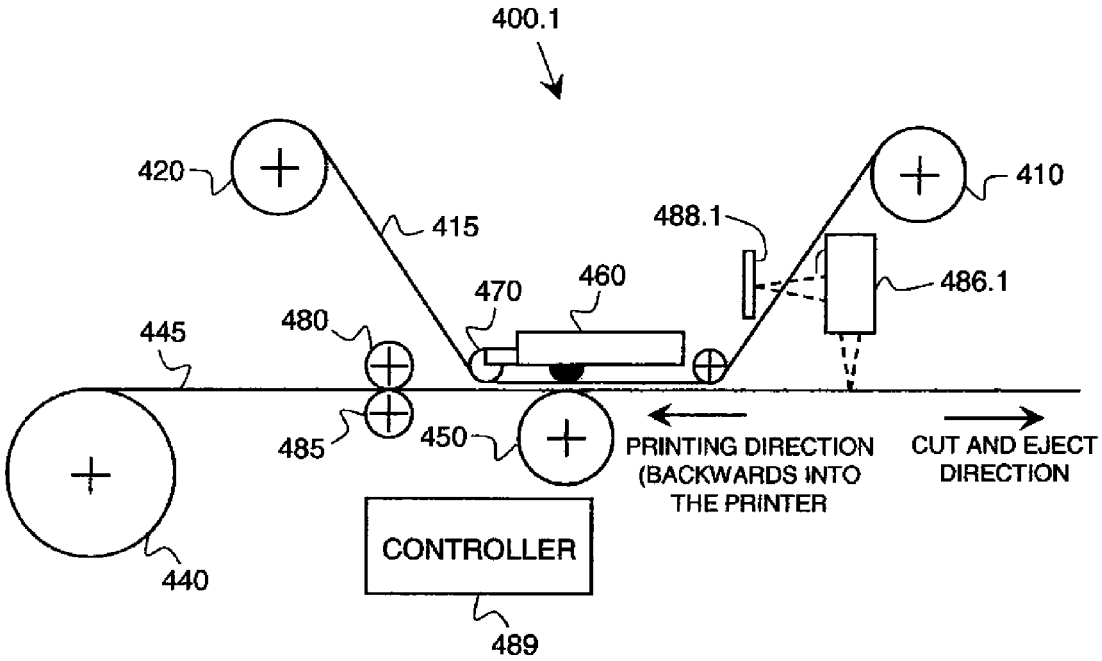
FIG. 7 illustrates an example of a thermal printer system of the present invention utilizing a beam splitter.
Figure 8A:
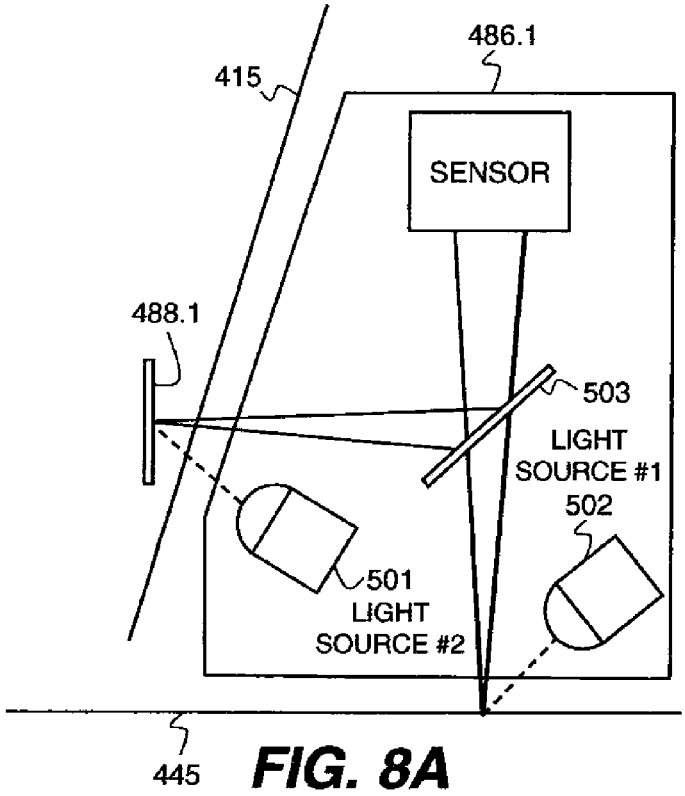
FIG. 8A illustrates an example of a color sensor (densitometer) enabled for a dual purpose by means of a beam splitter of the type used in FIG. 7.

Relating to the second aspect of this invention shown in FIG. 7, color sensor 486.1 provides dual functionality by a different mechanism. Instead of pivoting the color sensor between two positions to achieve the dual functionality, a beam splitter arrangement is utilized with two discrete light sources that are actuated from printer controller 20 in a mutually exclusive manner. Referring to FIG. 8A, light source 501 is activated and light source 502 is deactivated to use color sensor (densitometer) 486.1 as a donor position sensor. As the donor web 415 is transported, light from the color sensor (densitometer) 486.1 passes through the donor web 415 and is reflected off reflector 488.1 and back into the color sensor (densitometer) 486.1. In this manner, the position of the various donor patches, shown in FIG. 3: 34.1, 36.1, 38.1, 40.1, 34.2, 36.2, 38.2, and 40.2; can be determined and positioned for printing between thermal ceramic printhead 460 and platen roller 450 in a similar fashion to that described above.

When the color sensor (densitometer) 486.1 in FIG. 8A, has light source 501 deactivated and light source 502 activated, the printed receiver density can be measured for the purpose of neutral or color calibration in a similar fashion to that described above. Referring to FIG. 9, a test target 700 is printed on the receiver web 445. The test target contains a tone scale 701, consisting of a plurality of discrete dye patches ranging from light to dark (low density to high density). Each patch is scanned by color sensor (densitometer) 486 as the printed receiver is passed under it to determine its reflection density. The density information is passed to a calibration algorithm in controller 489, which can calculate new printing parameters to be utilized by controller 489 to make neutrally corrected and/or color corrected prints. Such calibration algorithms are known to those skilled in the art.

Figure 8B:
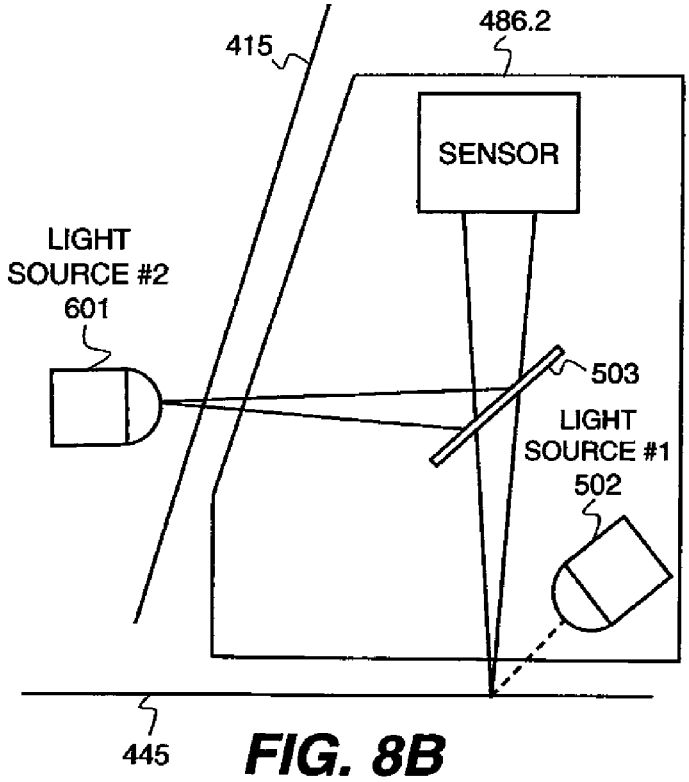
FIG. 8B illustrates another example of a color sensor (densitometer) enabled for a dual purpose by means of a beam splitter of the type used in FIG. 7.
Figure 8C:
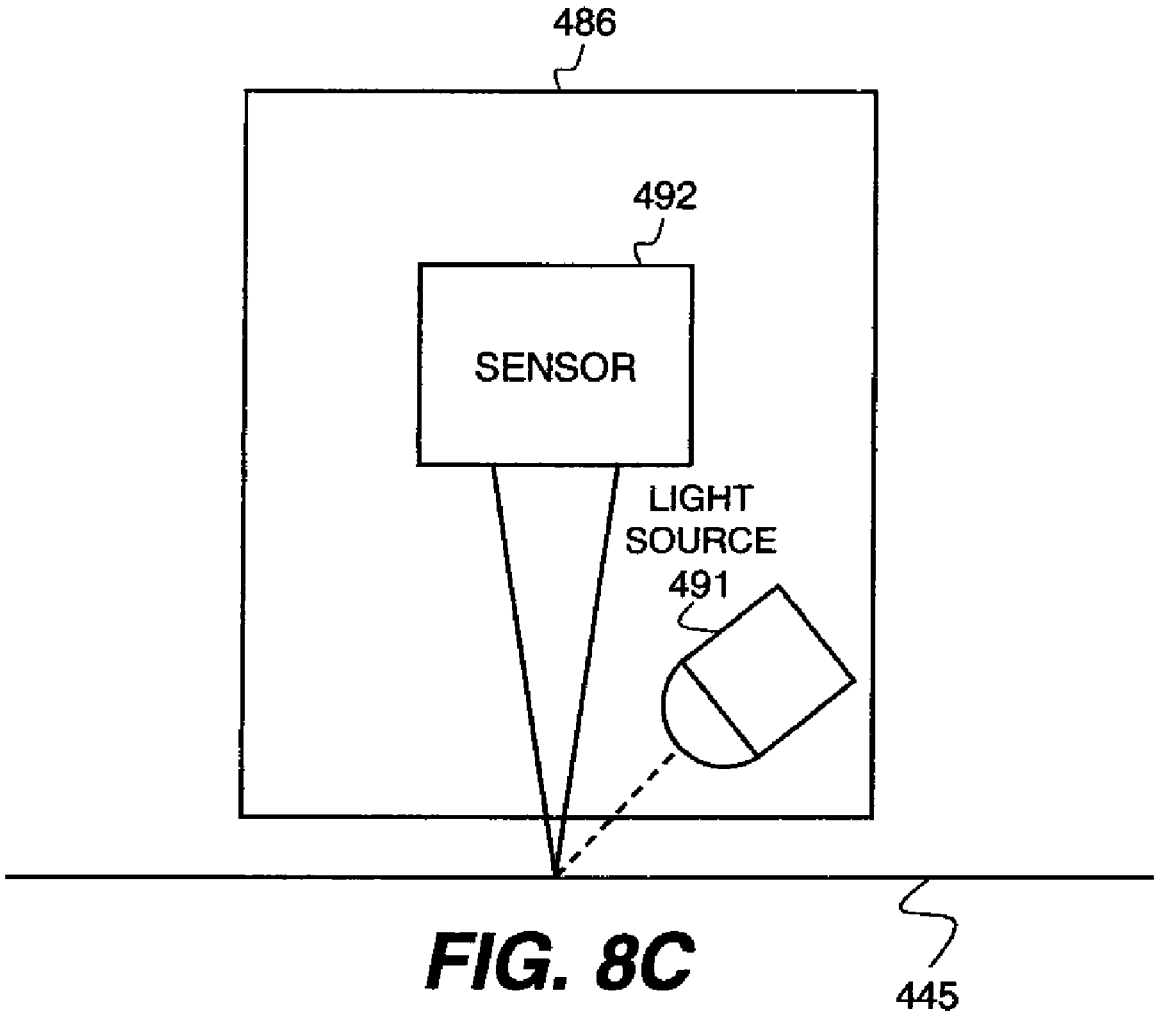
FIG. 8C illustrates an example of a reflection color sensor densitometer of the type used in FIG. 6.

An example of color sensor (densitometer) 486 is shown in FIG. 8C, which contains sensor 492 and light source 491 reflecting off receiver medium 445. Many such custom or commercially available densitometers can be utilized for this purpose, such as the X-Rite™ i1®.

Another embodiment of a color sensor (densitometer) 486.2 utilizing a beam splitter 503 and two light sources 601 is shown in FIG. 8B, where the reflector has been eliminated in favor of placing the light source 601 on the opposite side of donor web, eliminating the need for a reflector 488.1 in FIG. 8A. This will improve the signal to noise ratio at the sensor.

The initial printer settings can be established for example during an initial set up phase at a manufacturer's facility or elsewhere. However, because many aspects of printing, particularly color printing, are influenced by environmental conditions, printing process variations, and donor and receiver material variations, it is understood that, from time to time, it may be useful to recalibrate the initial printer settings to ensure that the colors that are printed correspond to colors called for in the print data. Such times can be determined, for example, when a user makes a request that the printer settings be recalibrated. Alternatively, controller 489 (FIGS. 6 and 7) can be adapted to perform calibration when a sensor (not shown) indicates that either receiver medium 440 or a donor material supply 410 has been changed or replenished, when a receiver medium or donor material type is changed, or when there has been a meaningfil shift in ambient temperature, humidity or other environmental conditions since a time of the last calibration. In still other alternative embodiments, controller 489 can monitor factors such as the number of prints since the last printer calibration of the printer settings and an amount of time since the last calibration to determine when printer settings should be recalibrated. In yet another embodiment, controller 489 can be adapted to determine that printer settings should be recalibrated on a periodic basis such as at a particular time of a day or week. In a further embodiment, controller 489 is adapted to print a calibration verification mark during the printing of images and to sense the color of the calibration verification mark, controller 489 can determine that a need for calibration of printer exists based upon whether the color of the calibration verification mark is within a range of acceptable colors. See, for example, the procedures described in U.S. Pat. No. 7,271,935, issued on Sep. 18, 2007, in the names of Coons et al.

For all of the embodiments described above, practical specifications will put additional constraints on the color sensor to have it utilized as a reflection densitometer. Such a sensor, so configured as a reflection densitometer, can then be utilized as a donor position sensor. Additional sensor embodiments might be realized that maintain the spirit of this invention.

The invention has been described in detail with particular reference to certain preferred embodiments thereof, but it will be understood that variations and modifications can be effected within the spirit and scope of the invention.

PARTS LIST

18 thermal printer
20 printer controller
22 printhead
26 receiver medium
30 donor web
32.1 first donor patch set (34.1, 36.1, 38.1, and 40.1)
32.2 second donor patch set (34.2, 36.2, 38.2, and 40.2)
34.1 yellow donor patch
34.2 yellow donor patch
36.1 magenta donor patch
36.2 magenta donor patch
38.1 cyan donor patch
38.2 cyan donor patch
40.1 clear donor patch
40.2 clear donor patch
42 receiver medium take-up roller
43 thermal resistors
44 receiver medium supply roller
45 ceramic substrate
46 platen roller
47 heat sink
48 donor web take-up roller
49 left side of ceramic substrate
50 donor web supply roller
51 circuit board
52 image receiving area
54 stripping plate
56 idler roller
62 user input system
64 output system
68 memory
71 removable memory interface
72 hard drive
74 communication system

76 remote memory
80 sensor system
82 donor position sensor
84 receiver medium position sensor
86 movement sensor
88 follower wheel
400 thermal printer schematic
410 donor supply spool
415 donor web
420 donor take-up spool
440 receiver medium
445 receiver medium
450 platen roller
460 thermal ceramic printhead
470 peel bar member
480 pinch roller
485 micro-grip roller
486 color sensor (densitometer)
486.1 color sensor (densitometer)
486.2 color sensor (densitometer)
487 pivot
488 reflector
488.1 reflector
489 controller
491 light source
492 sensor
501 light source (light source #2)
502 light source (light source #1)
503 beam splitter
601 light source
700 test target
701 tone scale
L leading edge
LER leading edge receiver
T trailing edge
TER trailing edge receiver

What is claimed is:

1. A sensor apparatus for providing two sensing operations within a thermal printer, comprising:

a) a densitometer having at least one light source, that discriminates color and that is positioned in a first position for sensing donor patches within the thermal printer; the densitometer while in a second position provides a plurality of signals from printed receiver media for internal color calibration of the thermal printer;

b) at least one reflector for directing light from the light source to the densitometer through a donor web when the densitometer is in the first position; and c) a switchable means for repositioning the densitometer from either the first position or the second position.

2. The sensor apparatus claimed in claim 1, wherein the densitometer upon sensing donor patches enables subsequent positioning of said donor patches for printing.

3. The sensor apparatus claimed in claim 1, wherein the switchable means for repositioning the densitometer comprises a means for articulating the densitometer about a pivot.

4. A sensor apparatus for providing two sensing operations within a thermal printer, comprising:

a) a densitometer that discriminates color and senses donor patch locations within the thermal printer during a first operation; the densitometer while in a second operation provides a signal for internal color calibration of a receiver media;

b) a plurality of light sources that can be controlled in a mutually exclusive manner to provide light through either a donor web or reflected light from a printed receiver; and c) at least one beam splitter that directs light beams from the plurality of light sources to enable either the first or second operations of the densitometer.

5. The sensor apparatus of claim 4, further comprising a reflector for directing at least one light beam from at least one light source to the densitometer through the donor web.

6. The sensor apparatus of claim 5, wherein the densitometer utilizes, for a first period of time, one light source when measuring reflection density of the printed receiver, and during a second period of time, when detecting location of a donor patch, a second light source coupled with a reflector positioned on the opposite side of the donor web than the first and second light sources.

7. The sensor apparatus of claim 4, wherein the donor web is positioned between the densitometer and at least one light source.

8. A method for providing two sensing operations within a thermal printing that employs a densitometer, comprising the steps of:

a) employing the densitometer to discriminate color and sense location of colored donor patches when positioned in a first position within the thermal printer;

b) employing the densitometer, while in a second position, to provide a signal for internal color calibration of receiver media; and c) switching the densitometer from either the first position or the second position to correspond to either donor position sensing or reflection density sensing, respectively.

9. A method for controlling operating functions of a densitometer assembly, comprising the steps of:

a) signaling the densitometer assembly to enable a donor sensing function, wherein the following steps are performed:

a1) repeatedly measuring color as a donor web is moving;

a2) detecting donor patch edges along the donor web;

a3) positioning the donor patch edges for printing; and b) signaling the densitometer assembly to enable a reflection measuring function, wherein the following steps are performed:

b1) directing the densitometer assembly, including a plurality of light sources, at a printed receiver;

b2) making reflection measurements of the printed receiver; and b3) calculating and adjusting printing parameters for subsequent printing.

* * * * *